US009757641B2

(12) United States Patent
Jones

(10) Patent No.: US 9,757,641 B2
(45) **Date of Patent: *Sep. 12, 2017**

(54) CARD SHUFFLING DEVICE WITH RFID CARD READER AND DISPLAY

(71) Applicant: Mark Hamilton Jones and Sheryl Lynn Jones Family, Gardnerville, NV (US)

(72) Inventor: Mark H. Jones, Genoa, NV (US)

(73) Assignee: Mark Hamilton Jones and Sheryl Lynn Jones, Gardnerville, NV (US), Trust dated November 7, 2013

( * ) Notice: Subject to any disclaimer, the term of this patent is extended or adjusted under 35 U.S.C. 154(b) by 75 days.

This patent is subject to a terminal disclaimer.

(21) Appl. No.: 14/172,463

(22) Filed: Feb. 4, 2014

(65) Prior Publication Data

US 2014/0246829 A1 Sep. 4, 2014

Related U.S. Application Data

(63) Continuation-in-part of application No. 14/149,288, filed on Jan. 7, 2014.

(60) Provisional application No. 61/760,502, filed on Feb. 4, 2013, provisional application No. 61/749,725, filed on Jan. 7, 2013.

(51) Int. Cl.

| | |
|---|---|
| ***A63F 1/12*** | (2006.01) |
| ***A63F 5/00*** | (2006.01) |
| ***G07F 17/32*** | (2006.01) |

(52) U.S. Cl.

CPC ..... *A63F 1/12* (2013.01); *A63F 5/007* (2013.01); *G07F 17/3213* (2013.01); *G07F 17/3293* (2013.01)

(58) Field of Classification Search

CPC ..... A63F 1/12; A63F 1/14
USPC ..... 273/149 R; 463/22
See application file for complete search history.

(56) References Cited

U.S. PATENT DOCUMENTS

| | | | | |
|---|---|---|---|---|
| 3,176,841 | A * | 4/1965 | Staats | 209/571 |
| 3,273,709 | A * | 9/1966 | Staats | 209/571 |
| 3,566,524 | A * | 3/1971 | Irasek | 353/27 R |
| 3,841,637 | A * | 10/1974 | Piazza et al. | 273/141 A |
| 4,531,187 | A * | 7/1985 | Uhland | 463/12 |
| 4,667,959 | A * | 5/1987 | Pfeiffer et al. | 273/149 R |
| 5,275,411 | A * | 1/1994 | Breeding | 273/149 R |
| 5,989,122 | A * | 11/1999 | Roblejo | 463/22 |
| 7,500,672 | B2 * | 3/2009 | Ho | 273/149 R |
| 7,719,424 | B2 * | 5/2010 | Steil | 340/572.4 |

(Continued)

*Primary Examiner* — Aarti B Berdichevsky
*Assistant Examiner* — Dolores Collins
(74) *Attorney, Agent, or Firm* — John S. Artz; Dickinson Wright PLLC

(57) ABSTRACT

A card shuffling machine for a game of chance includes a base portion and a rotatable body in communication with the base portion. The rotatable body portion includes a plurality of slots disposed therein. Each of the plurality of slots is configured to receive a card of the defined set of cards. Each of the cards includes indicia relevant to an outcome of the game of chance. The shuffling machine includes at least one reader associated with one of the plurality of slots and configured to communicate with the card disposed in the one slot to obtain information about the indicia of the card. The card shuffling machine includes a display in communication with the at least one reader for displaying the indicia of the card when the card is in the slot.

21 Claims, 9 Drawing Sheets

(56) References Cited

U.S. PATENT DOCUMENTS

| | | | | |
|---|---|---|---|---|
| 7,753,374 | B2 * | 7/2010 | Ho | 273/149 R |
| 7,926,810 | B2 * | 4/2011 | Fisher et al. | 273/274 |
| 8,298,062 | B2 * | 10/2012 | Kido | 463/17 |
| 8,505,919 | B2 * | 8/2013 | Jones | 273/292 |
| 8,628,086 | B2 * | 1/2014 | Krenn et al. | 273/149 R |
| 8,777,727 | B2 * | 7/2014 | Jones | 463/22 |
| 2003/0064798 | A1 * | 4/2003 | Grauzer et al. | 463/29 |
| 2005/0288089 | A1 * | 12/2005 | Cammegh et al. | 463/17 |
| 2008/0132316 | A1 * | 6/2008 | Fisher et al. | 463/17 |
| 2009/0124323 | A1 * | 5/2009 | Dunn et al. | 463/17 |
| 2013/0137501 | A1 * | 5/2013 | Jones | 463/20 |
| 2013/0181401 | A1 * | 7/2013 | Jones | 273/138.1 |
| 2013/0307216 | A1 * | 11/2013 | Jones | 273/149 R |
| 2014/0246829 | A1 * | 9/2014 | Jones | 273/149 R |
| 2014/0256392 | A1 * | 9/2014 | Jones | 463/12 |

* cited by examiner

CARD SHUFFLING DEVICE WITH RFID CARD READER AND DISPLAY

CROSS-REFERENCE TO RELATED APPLICATIONS

The present application claims priority to U.S. Provisional Patent Application Ser. No. 61/760,502 filed on Feb. 4, 2013 and entitled "Automated Multi-Game Card Reading Apparatus", and is a continuation-in-part of U.S. patent application Ser. No. 14/149,288 filed on Jan. 7, 2014 and entitled an "Automated Table Game System" which claims priority to U.S. Provisional Patent Application Ser. No. 61/749,725 filed on Jan. 7, 2013 and entitled an "Automated Multi-Game Card Reading Apparatus", the disclosures of which are hereby incorporated by reference as though set forth fully herein.

TECHNICAL FIELD

The present disclosure relates generally to a machine for randomly selecting a single card from among a set of cards in a game of chance, which provides increased player enjoyment. More particularly, the present invention relates to a system involving a card shuffling device that randomly selects a single card from among a set of cards in a game and automatically displays the indicia of each card in the card shuffling device that provides increased enjoyment to players.

BACKGROUND OF THE INVENTION

Games of chance are well known activities whose outcomes are strongly influenced by randomizing devices and upon which contestants may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices. For this reason, the gaming industry is continuously developing new games, and new randomizing devices to maintain player interest and attract new players.

Games of chance that include money wagers are typically regulated by governing authorities. These governing authorities enforce laws and regulations that are enacted to curtail certain kinds of games, as well as certain kinds of randomizing devices. For example, in some jurisdictions, the use of dice or roulette wheels to resolve a game outcome, i.e., as the randomizing device, have been curtailed while other randomizing devices such as playing cards are permitted. More frequently, randomizing devices that use playing cards have been utilized as they enjoy fewer restrictions in games played for money, than dice and roulette wheel randomizing devices.

However, current card shuffling devices still have some drawbacks. For example, most card shuffling devices retain the cards in a fashion such that that the indicia of the card cannot be readily seen when the card is in the shuffling device. The indicia of the card can only be seen after the shuffling device has stopped and the selected card has been removed from the device. Consequently, the suspense that exists with some other random number devices, such as roulette wheels, is not provided by current card shuffling devices. It would therefore be desirable to provide a card shuffling device that addresses these drawbacks and provides increased user enjoyment for players.

SUMMARY OF THE INVENTION

It is therefore an aspect of the present disclosure to provide a card shuffling device for a table game system that provides increased player enjoyment.

It is another aspect of the present disclosure to provide a card shuffling device for a table game system that provides increased player involvement and interaction.

It is a further aspect of the present disclosure to provide a card shuffling device for a table game system that can improve the efficiency of the casino dealers.

It is still another aspect of the present disclosure to provide a card shuffling device for a table game system that can minimize dealer errors and bleed.

It is yet another aspect of the present disclosure to provide a card shuffling machine for a table game system that can provide increased security measures.

It is still a further aspect of the present disclosure to provide a card shuffling device that can minimize the need for dealer involvement.

In accordance with the above and the other advantages, a card shuffling machine for a game of chance is provided. The card shuffling machine includes a base portion and a rotatable body portion in communication with the base portion. The body portion includes a plurality of slots therein that are configured to receive a card of a defined set of cards. Each of the cards in the defined set of cards is configured with indicia relevant to an outcome of the game of chance. Each slot includes a reader associated therewith for obtaining the card indicia information from the card disposed in the respective slot. Each reader is in communication with an associated display to present the indicia of the card in the slot to players of the game.

BRIEF DESCRIPTION OF THE DRAWINGS

These and other features and advantages of the present invention will become more readily appreciated when considered in connection with the following detailed description and appended drawings wherein.

DETAILED DESCRIPTION OF THE PREFERRED EMBODIMENT

Figure 1:
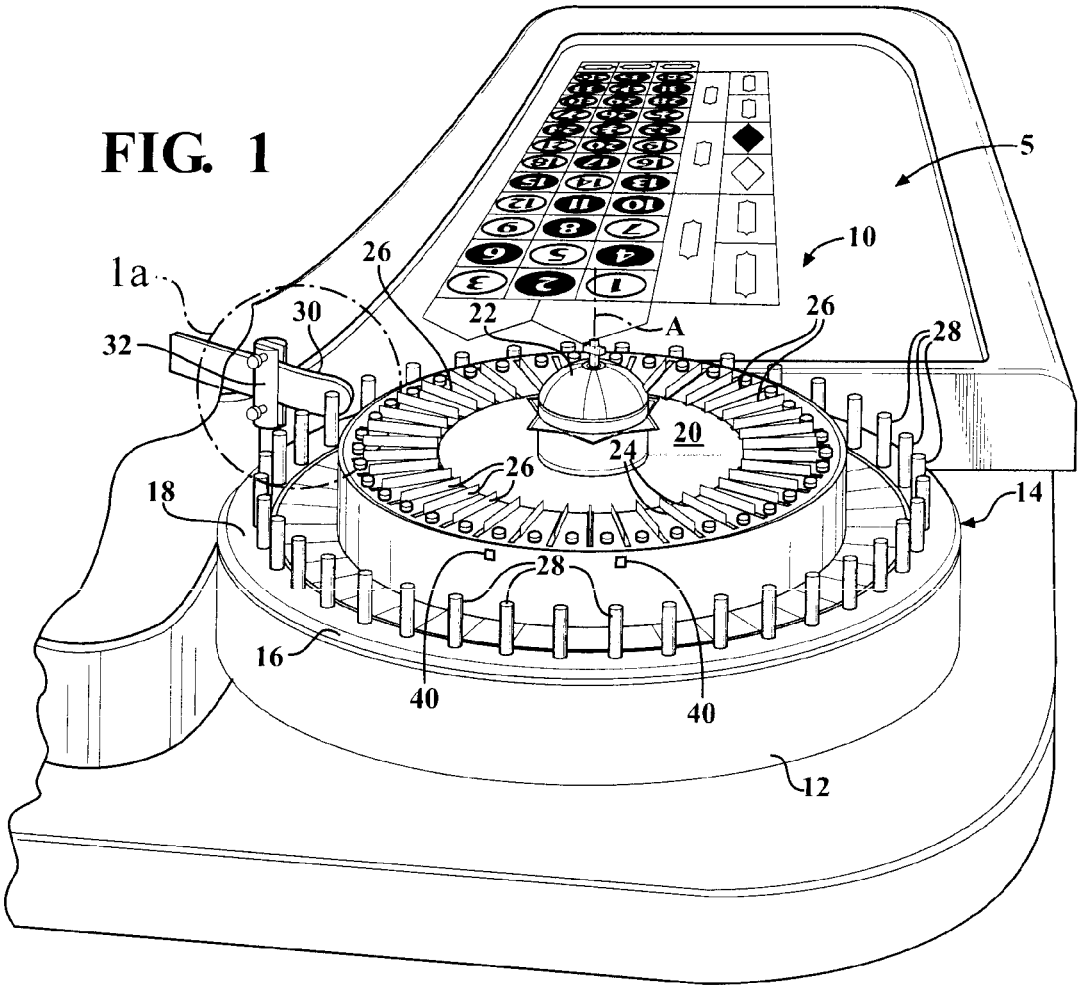
FIG. 1 is a perspective view of a table game system, including a card shuffling device, according to an aspect of the disclosure.
Figure 2:
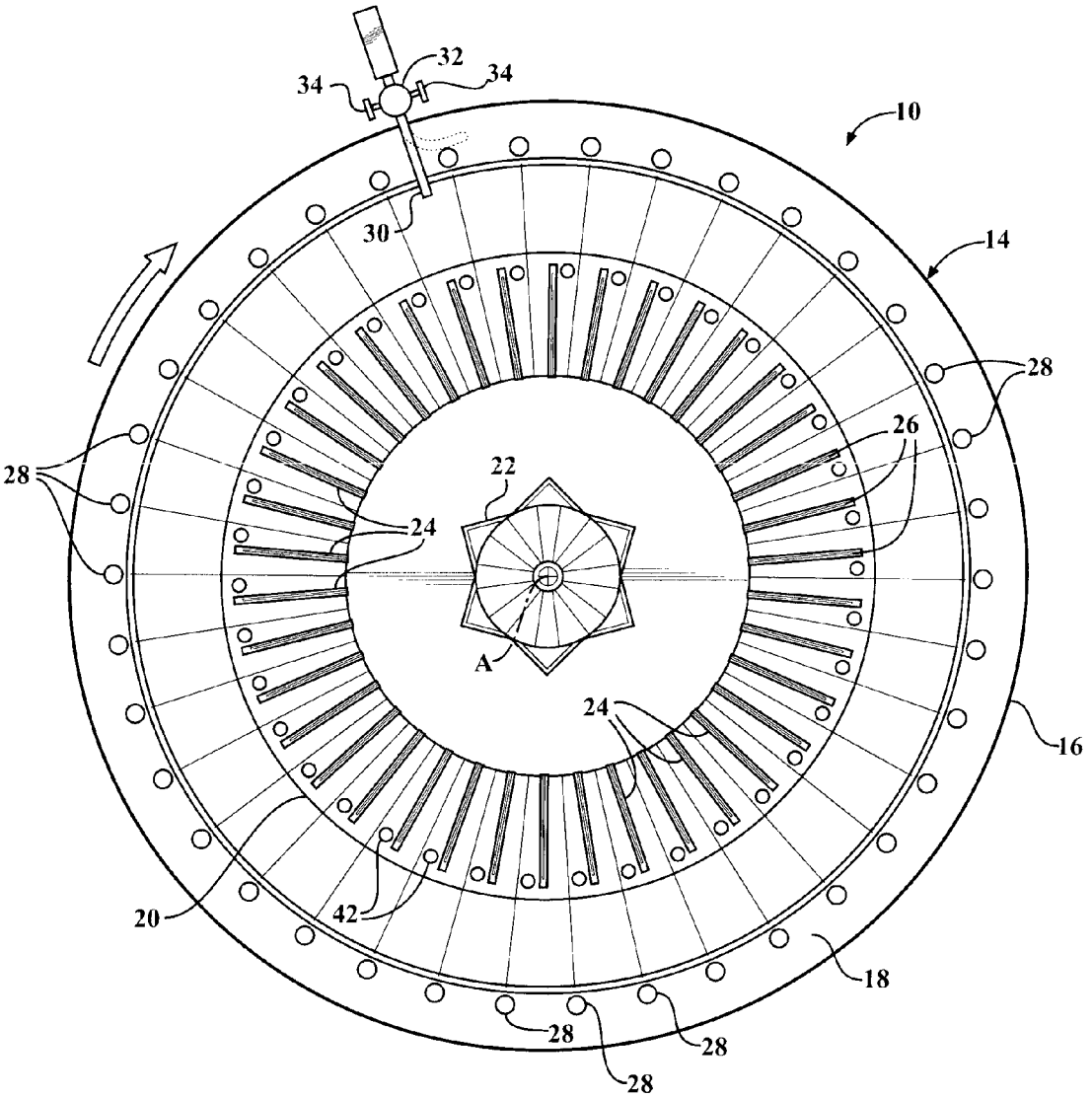
FIG. 2 is a top schematic view of the card shuffling device of FIG. 1.

According to an aspect of the disclosure, a card shuffling device for selecting a card from among a set of cards in a game of chance is generally shown at 10 in FIGS. 1 and 2. The card shuffling machine 10 may be part of a table game system 5 for a game of chance such as roulette. According to another aspect, the table game system 5 may be utilized for other games of chance such as craps, blackjack, war, poker and the like.

The shuffler device 10 randomly selects a single card from among the set of cards and includes a stationary base 12 which is effective to establish a generally vertical central axis A. In accordance with one aspect of the disclosure, the base 12 is shown as a squat, generally cylindrical member. However, this configuration can be varied as desired. A turntable 14 can be movably supported above the base 12 for free rotation within a generally horizontal plane about the central axis A. The turntable 14 may have a generally circular outer periphery 16, and as shown by the example in the Figures can be configured with multiple levels forming a hat-like construction. More specifically, an outer rim section 18 may be circumscribed by the outer periphery 16 and rest directly above the stationary base 12. According to an aspect, an elevated stage section 20 can be centrally located therein. A decorative crown piece 22 may be affixed centrally within the stage section 20 for purely aesthetic purposes. It will be appreciated that the shuffling machine 10 can take on a variety of different configurations and may operate in a variety of different ways.

The stage section 20 of the turntable 14 includes a plurality of trays 24. According to an aspect, the defined plurality of trays 24 may consist of exactly thirty-eight trays. Depending upon the game of chance to be played, however, the defined plurality of trays 24 can be varied to include more than or less than the exemplary thirty-eight trays illustrated here. The trays 24 may be equally circumferentially spaced apart one from another about the central axis A. In other words, in this exemplary aspect where thirty-eight trays 24 are provided, each tray 24 occupies a sector of approximately 9.47 degrees. If the number of trays 24 were decreased to thirty-six, for example, each tray 24 would occupy a sector of exactly 10 degrees, and so forth. The trays 24 may, as shown in the FIGs, comprise narrow slots arranged along radials extending from the central axis A. According to an aspect, each slot can be sized, shaped and oriented so as to hold a single playing card 26 in a vertically upstanding orientation. It will be appreciated that the configuration of the slots may vary. Also, the cards 26 can be retained in a variety of other suitable ways. According to another aspect, the cards 26 may be oriented on the turntable 14, such that the card indicia are visible to players while the turntable 14 rotates. In other words, the card indicia can be face up.

Figure 9:
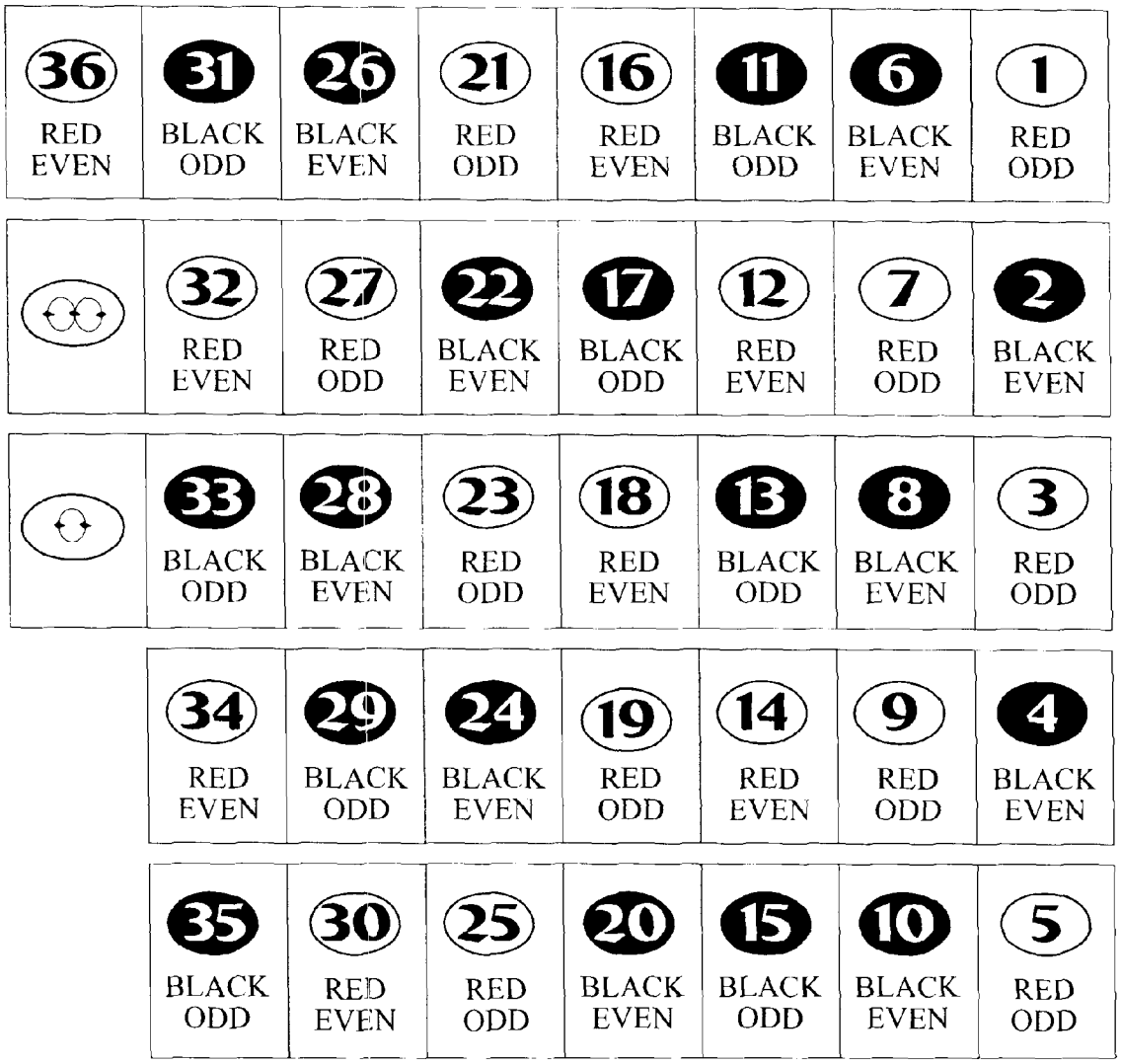
FIG. 9 is a schematic illustration of a set of playing cards in accordance with an aspect of the disclosure.
Figure 10:
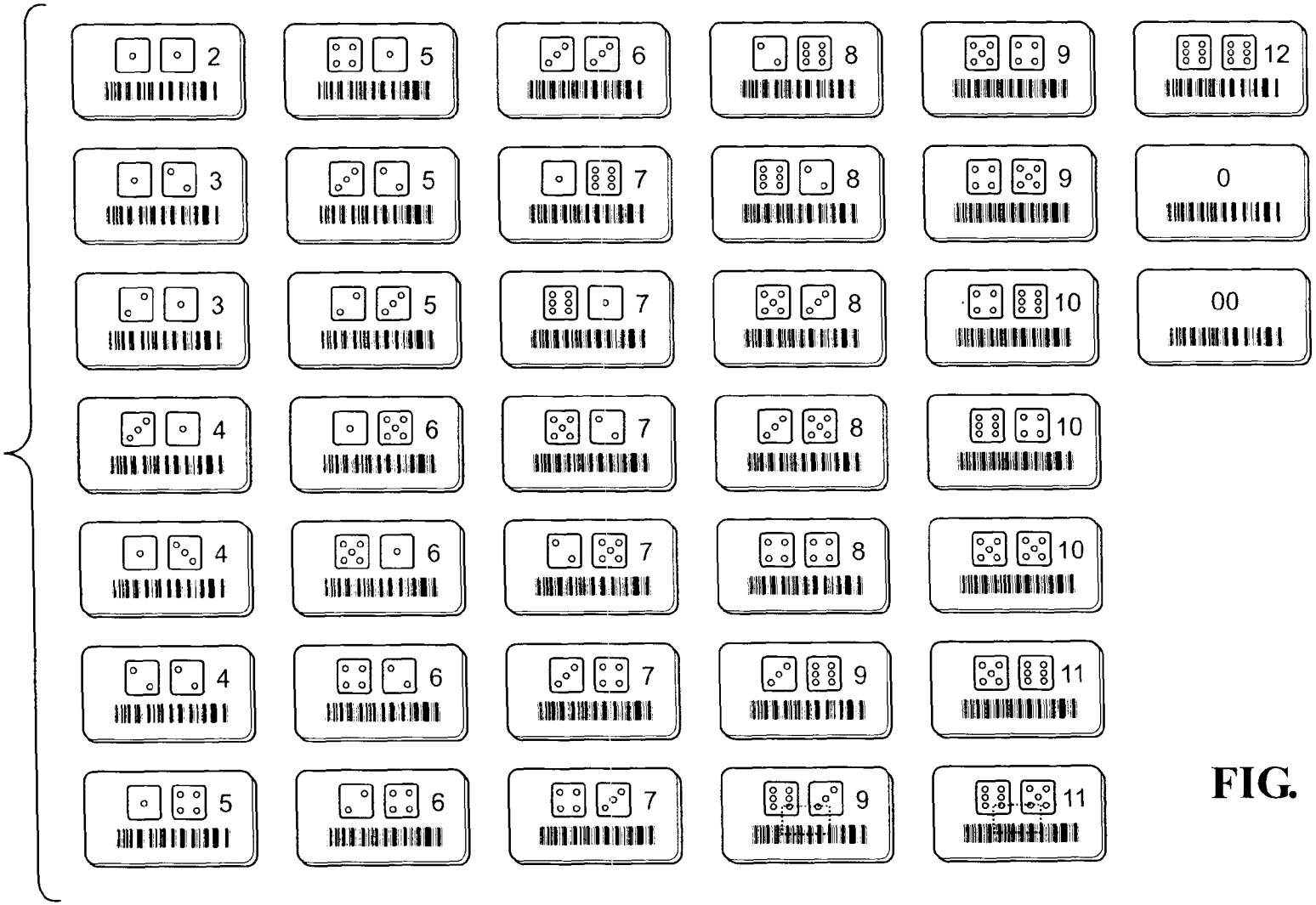
FIG. 10 is a schematic illustration of a set of playing cards in accordance with another aspect of the disclosure.

The cards 26 may be dimensionally similar to those used for playing card games like poker, blackjack and the like. Instead of the traditional rectangular configuration, the cards 26 may be shaped in other interesting or effective geometries. According to an aspect, the set of cards 26 may be equal in number to the defined plurality of trays 24. In keeping with the previously proposed example of thirty-eight trays, a set of cards would consist of thirty-eight distinct cards. FIG. 9 illustrates exemplary cards 26 according to an aspect where they bear indicia for the game of roulette. FIG. 10 illustrates another aspect, wherein thirty-eight cards 26 comprise a distinct set of cards and bear indicia for a game of chance played according to the rules of craps. It will be appreciated that the cards may be configured for other games and more or less cards may be employed.

Figure 7:
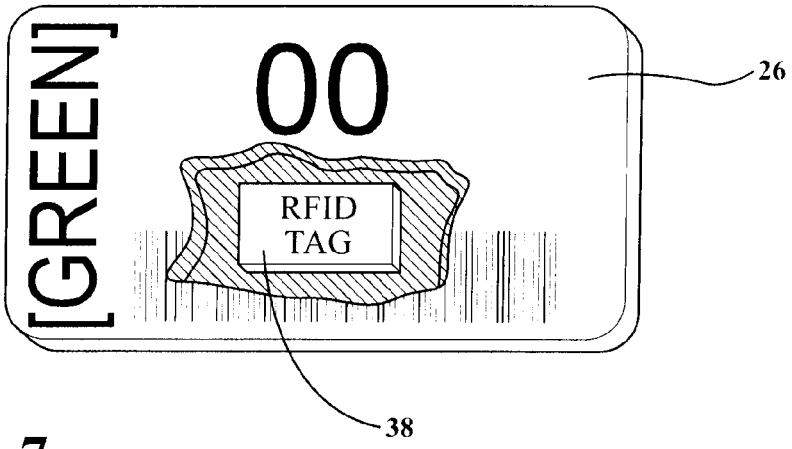
FIG. 7 is a schematic illustration of an exemplary playing card in accordance with an aspect of the disclosure.

According to an aspect and as exemplarily shown with reference to FIG. 7, each card 26 bears indicia related to a decision for a game of chance. This exemplary card 26 reflects one of the numbers or results associated with the game of roulette. As shown, the card 26 bears indicia for the number 00 and the color green. According to an aspect, the card 26 also includes an RFID tag 38 embedded therein. As will be understood, the RFID tag 38 can contain the information about the card indicia, i.e., color and number thereon.

According to an aspect, the trays 24 are arranged so as to hold each card 26 such that its long edges are oriented horizontally, and its short edges are oriented vertically. The depth of each slot in the trays 24 may be less than the narrow width of each card 26, so that a noticeable, protruding portion of each card 26 can extend above the stage section 20 of the turntable 14. This protruding portion can allow the dealer or operator of the game of chance using the card shuffling machine 12 to easily remove a card 26 from its tray 24 by grasping the protruding portion. By this configuration, each card 26 can be loosely contained in its respective tray 24 without the use of fastening devices, spring clips, or any other fixation medium. According to another aspect, the protruding portion of the card can be grasped by a mechanical arm such as is disclosed in Applicant's co-pending U.S. Provisional Patent Application Ser. No. 61/749,725, entitled "Automated Multi-Game Card Reading Apparatus", filed Jan. 7, 2013, the disclosure of which is hereby incorporated by reference. Additionally, the cards 26 can be retained to the device 10 in a variety of different ways can also be removed in different fashions.

As shown, the rim section 18 of the turntable 14 can be provided with a plurality of dividers 28. The plurality of dividers 28 may be equal in number to the defined plurality of trays 24. Thus, in the exemplary embodiment where thirty-eight trays are provided, the number of dividers 28 is also thirty-eight. The dividers 28, like the trays 24, can also be spaced one from another in equal circumferentially-spaced increments about the central axis A. Thus, if the trays 24 are spaced one from another 9.47 degrees, the dividers 28 are likewise spaced one from another 9.47 degrees. Accordingly, the space between each divider 28, as measured from center-line to center-line, occupies a sector equal to 9.47 degrees, or whatever arcuate measure is achieved when the number 360 is divided by the number of dividers 28. Preferably, although by no means necessarily, the dividers 28 can be oriented so as to perfectly bisect the angular sector between each adjacent tray 24. Said another way, a radial extending from each divider 24 to the central axis A is preferably, but not necessarily, offset from the center-line of each adjacent tray 24 by an angular measure equal to the total number of trays 24 divided by 720. In this manner, the space or gap between each divider 28 may be exclusively associated with one specific tray 24.

Figure 1A:
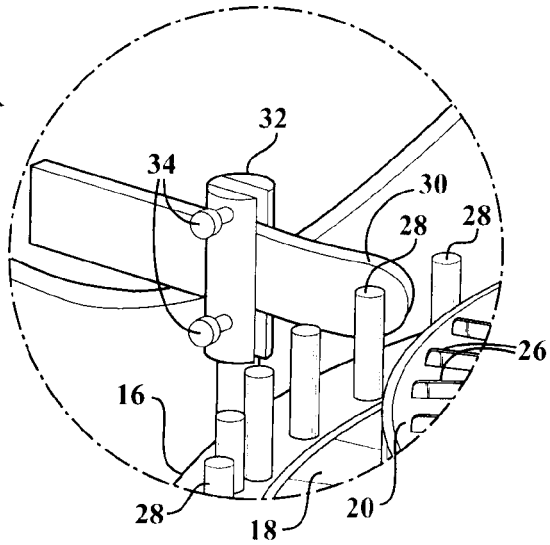
FIG. 1*a* is enlarged view of the portion in the circle of FIG. 1.

As best show in FIG. 1*a*, a detent 30 can be fixed relative to the base 12 to operatively interact with the dividers 28. According to an aspect, the detent 30 can function to apply a pulsating resistance to the free rotation of the turntable 14 and thereby progressively slow the turntable 14 to a stopped condition relative to the base 12. According to an aspect, the detent 30 may comprise a resiliently flexible tongue 36 supported in a retractable clamping holder 32 so that the tongue 36 can be withdrawn from the movement path of the dividers 28. In this example, the dividers 28 comprise upstanding pegs which are fixed to the rim section 18 of the turntable 14 at exactly equally radially spaced measurements from the central axis A. It will be appreciated that the divider 28 can take on a variety of different configurations.

According to an aspect, as the turntable 14 is rotated in the direction of the arrow in FIG. 2, the tongue-like detent is moved to a position that interferes with the paths of the dividers 28. When spun forcefully, the angular momentum of the turntable 14 is sufficient to deflect the detent 30 out of the way in a flipper-like fashion typical of prize wheel type randomizing devices known in the prior art. The tongue 36 of the detent 30 may be made of a felt-like material, or other suitable material. Each sequential impact and deflection of the detent 30 caused by the rotating dividers 28 can result in a pulsating resistance which slows the turntable 14 and eventually brings it to a complete stop.

The clamping holder 32 may be provided with clamping screws 34 that can be used to tighten or loosen the clamping force upon the detent 30. Preferably, the clamping force is set so that an operator of the card shuffling machine 10 can manually withdraw the detent 30 out of the path of the rotating dividers 28, thereby allowing the turntable 14 to freewheel. When the detent 30 is returned to its position within the path of the moving dividers 28, the detent 30 is operative to frictionally encounter the dividers 28, with each frictional encounter retarding the spin of the turntable 14 until there are enough such encounters to stop the turntable 14. However, those with skill in the art will readily appreciate many alternative detent type mechanisms, both mechanical and electromagnetic, may be employed to achieve substantially similar results from that of the preferred embodiment just described. According to another aspect, instead of a detent, the turntable 14 can be in communication with a computer to automatically rotate and stop the rotation of the turntable 14 as will be understood by one of ordinary skill in the art.

According to an aspect, the card shuffling machine 10 may also include some type of pointing device, which is fixed relative to the base 12, for identifying one of the plurality of trays 24 when the turntable 14 comes to rest. In accordance with one aspect, the pointer may be is integral with the detent 30, in that the tray 24 residing between the dividers 28 on opposite sides of the detent 30, when the turntable 14 comes to rest, will determine which card 26 is to be selected or identified for the purpose of determining game outcome. The pointer may alternatively be disposed on the based 12 to identify the selected. The pointer may be disposed in other locations to identify the selected card.

According to another aspect, the shuffling machine 10 can include a plurality of readers 40 disposed adjacent each of the plurality of trays 24. The readers 40 may be RFID readers 40 that can be located so as to communicate with a respective RFID tag 38 of each of the plurality of cards 26 in the defined set of cards when disposed in respective tray 24. The number of RFID readers 40 is preferably equal to the number cards 26. According to another aspect, the shuffling machine 10 can include a display 42 located adjacent each of the plurality of trays 24 for displaying the indicia of the card 26 disposed in the tray 24 associated with that display 42. When card 26 is disposed in a tray 24, the RFID reader 40 can automatically read the indicia of the card as stored on the RFID tag 38. The RFID reader 40 can then transmit this to the display 42 such the indicia of the card, i.e., number and color, may be known despite the actual indicia being hidden in the tray 24. The displays 42 allow players of the game to follow and watch the numbers and indicia of the cards as the turntable 14 rotates. Other readers or devices of obtaining information about the cards may be employed.

According to a further aspect, the shuffling machine 10 could include a reader disposed on or adjacent the machine 10 to communicate with the cards as the turntable 14 rotates. Once the cards are in their respective trays or slots, as the turntable 14 rotates, the cards pass the reader which obtains the indicia from each of the cards in order to identify them and their location. According to an aspect, the reader could be disposed at the 3:00 position. It will be appreciated that the reader could be disposed in a variety of other locations. According to an aspect, once the turntable 14 has made a complete rotation, such that all the cards have passed the reader, information about all the cards will have been obtained. The reader may be in communication with the computer to transfer the card indicia thereto as it is read and obtained. Accordingly, the identity and location of each card with respect to one another will be known after one revolution of the turntable. The computer can then communicate the information to the displays associated with each slot such that the card indicia are displayed for viewing by players. Alternatively, the computer can generate a pictorial representation of the wheel with the location of the cards and their indicia which may then be exhibited on the various monitors associated with the system 5.

According to another aspect, the cards could include information about the card indicia on its back, such as on a UPC code of the like. The reader could be equipped to read the UPC code on the back of the card, while the card is affixed to the device 10 or while it is being disposed thereon. The reader can be in communication with the computer to transmit and then display the information.

According to still an additional aspect of the disclosure, the system 5 could utilize a reader, such as a video device, that memorizes the card indicia through facial recognition. The reader can again be in communication with the computer to transfer this facial recognition information such that the location of each card indicia on the turntable 14 can be displayed for viewing by players or viewers of the game. This information could be displayed on the monitors, the player terminals, and/or the displays. It will be appreciated that other types of readers may be employed. It will also be appreciated that other ways of embedding this information on the card, including readable forms, may be employed.

Figure 3:
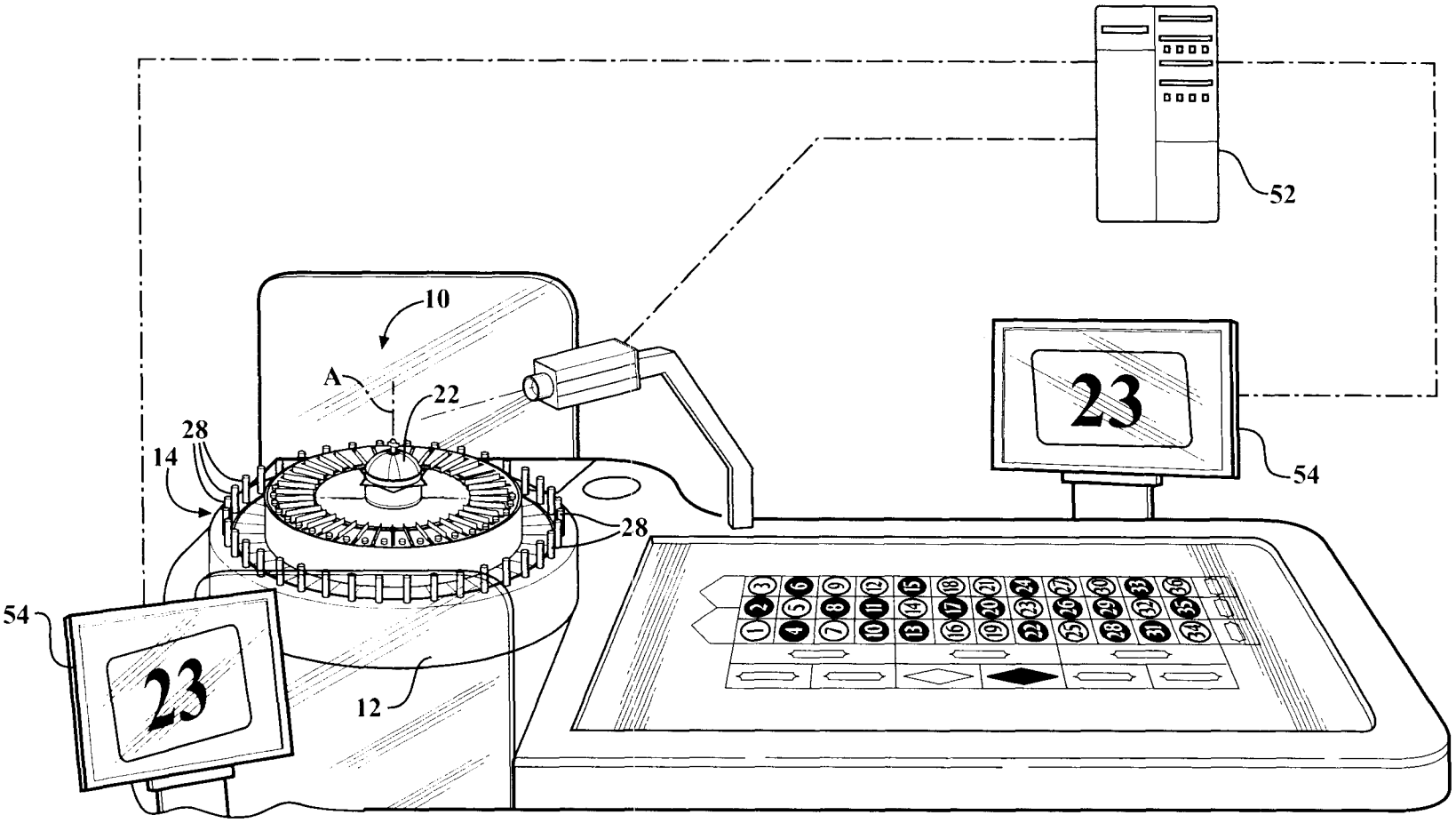
FIG. 3 is perspective view of a table game system, including a card shuffling device, according to another aspect of the disclosure.

FIG. 3 illustrates another aspect of the present disclosure. According to this aspect, the system 5 includes a video capturing device 50 that is located adjacent the turntable 14 and is positioned to capture video of the card shuffling machine 10 as it rotates. The video capture device 50 may be a video camera or the like. The video capturing device 50 may be in communication with a computer or digital processor 52 to transmit a video feed thereto. According to another aspect, the computer 52 can be in communication with one or more monitors 54 such that the video of the turntable 14 rotating and the associated displays 42 can be seen by players of the game. This will allow players of the game to actually see the location of their desired numbers with respect to the detent 30 or the pointer to identify the location of the selected card 26. According to another aspect, the RFID readers 40 can be in communication with the computer 52, such as by a wireless connection, so that the monitors 54 can display the indicia of the selected card.

According to a still further aspect, the video capture device 50 may be utilized to display the selected card after it has been removed from its tray by the game operator. By this method, players of the game of chance can reliably see the indicia of the one selected card 26 and thereby be assured that the correct game decision has been announced.

Figure 4:
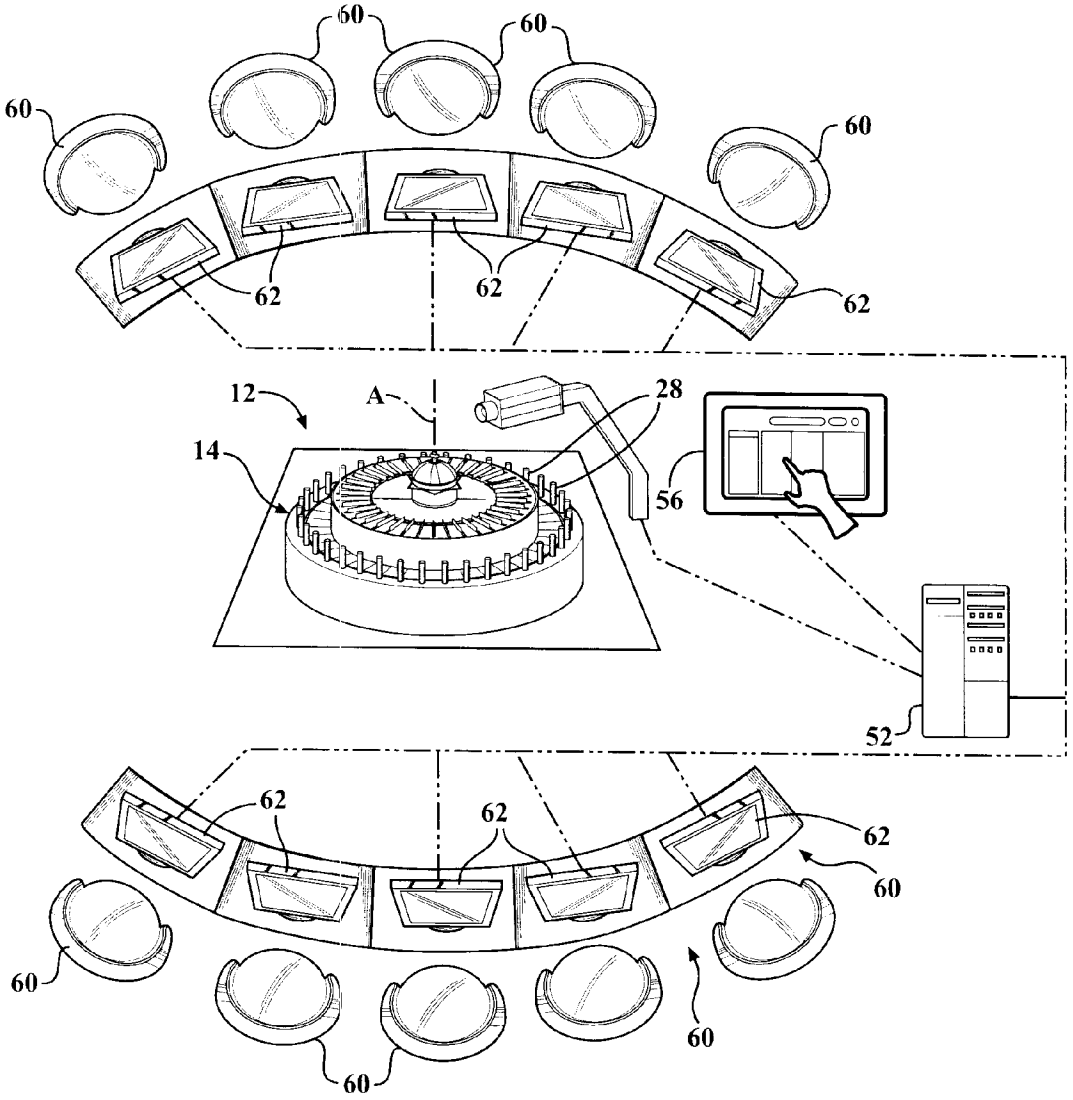
FIG. 4 is a schematic view of a table game system, including a plurality of player terminals, in accordance with a further aspect of the disclosure.

FIG. 4 illustrates the table game system 5 in accordance with another aspect of the present disclosure. As shown, the table game system 5 includes a shuffling machine 10 that can each select a single card 26 from a full set of cards. The system 5 includes a computer 52 that is in communication with the plurality of RFID readers 40 disposed in the turntable 14 adjacent each of the plurality of cards 26. According to another aspect, a dealer can be present to ensure smooth operation of the game of chance. The system 5 can also include a dealer terminal 56 that allows the dealer to input information, such as the card indicia. The dealer terminal 56 may also be in communication with the computer 52 such that the input information can be displayed on the monitors 54.

Additionally, the system 5 can include a plurality of individual player terminals 60. According to an aspect, each of the player terminals 60 may be in communication with the computer 52. Players stationed at respective player terminals 60 may place wagers at their respective terminal 60. Once the card 26 has been selected and registered by the computer 52, such as after being input by a dealer into to dealer terminal 56, wagers can be automatically resolved at each of the player terminals 60. Monitors 62 associated with each player terminal 60 can also allow players to monitor the play of the game of chance.

Figure 5:
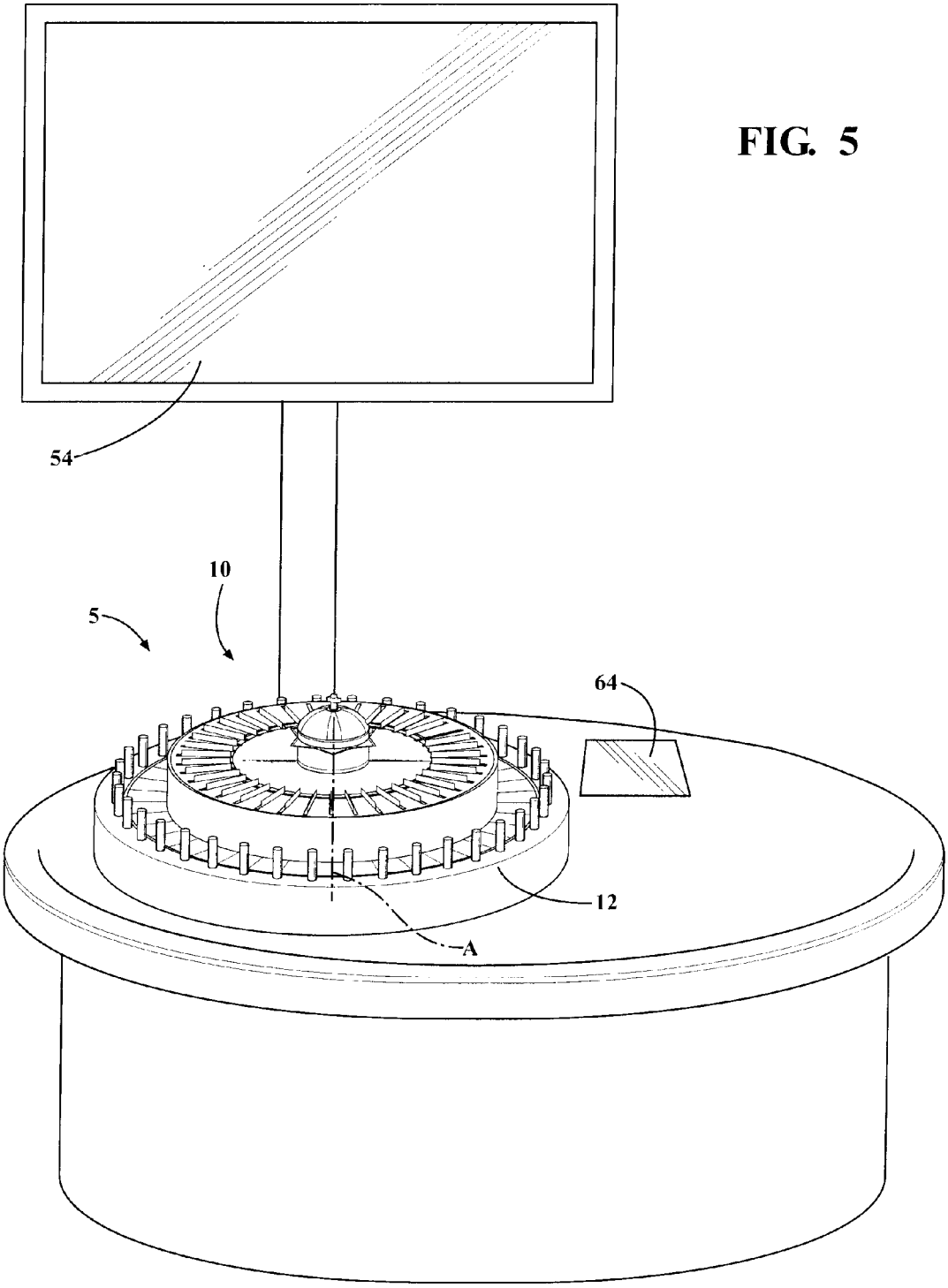
FIG. 5 is a perspective view of a table game system, including a card shuffling device in accordance with yet another aspect of the disclosure.
Figure 6:
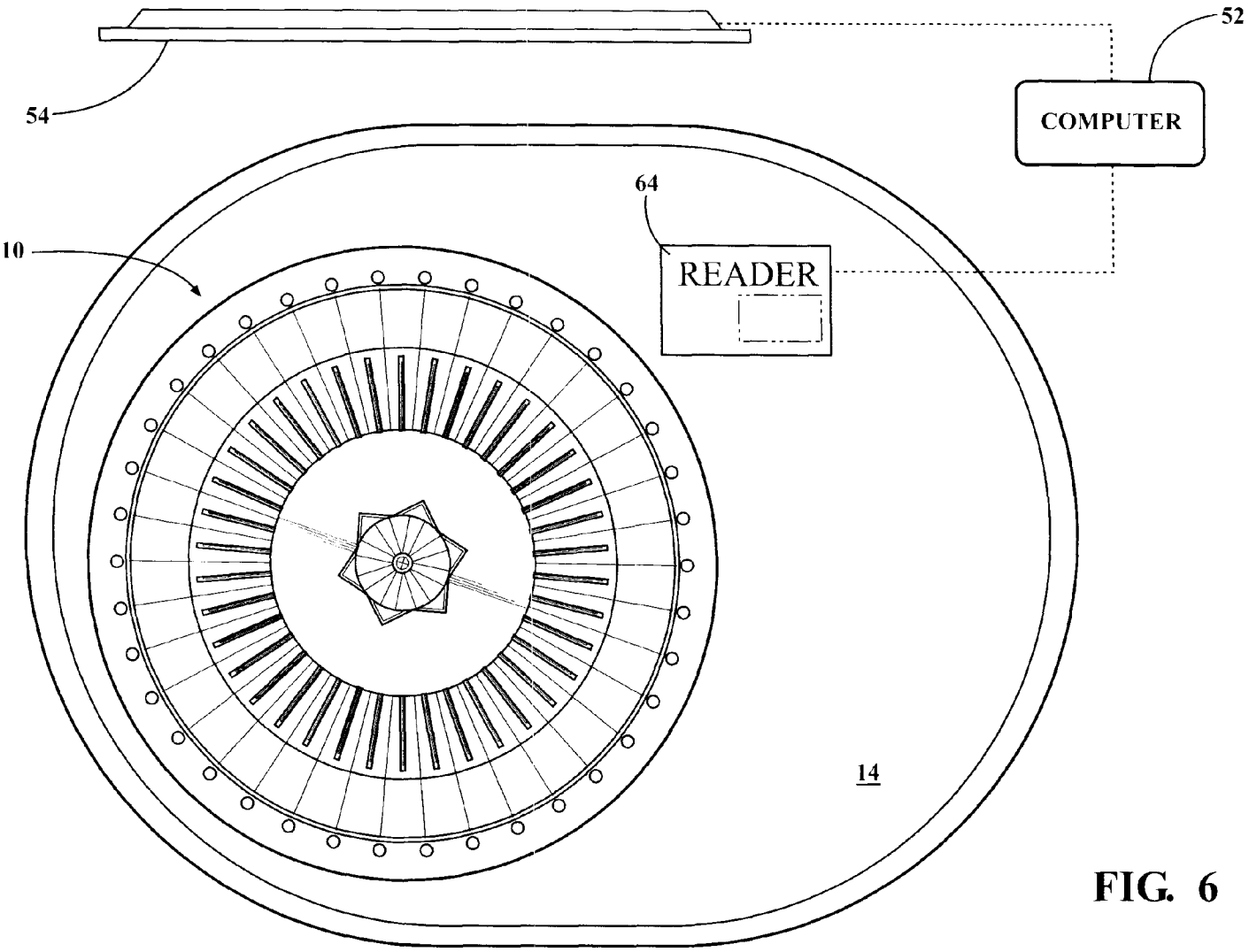
FIG. 6 is a top schematic view of a card shuffling device according to the aspect of FIG. 5.

FIGS. 5 and 6 illustrate a table game system 5 according to still another aspect of the disclosure. The table game system 5 includes a card shuffling machine 10. According to an aspect, a card reader 64 is disposed adjacent the card shuffling machine 10. The card reader 64 may be in communication with the computer 52. According to an aspect, when the turntable 14 stops rotating and a card 26 has been selected to determine the outcome of the game of chance, the selected card 26 could be removed from its slot and placed in communication with the card reader 64 such that its indicia can be read via the RFID tag 38. The card reader 64 can transmit the information read from the RFID tag 38 to the computer 52 for display on the monitors 54 and for processing with respect to the outcome of the game of chance. According to another aspect, the card readers 40 may be any other suitable electronic scanning devices that can input the information from the selected card 26 to the computer 52. According to an aspect, the card 26 may be manually transferred to the card reader 64, such as by a live dealer. Alternatively, the card 26 may be transferred without human intervention, such as by a mechanical arm, as is illustratively disclosed in Applicant's co-pending U.S. Provisional Patent Application Ser. No. 61/749,725, entitled "Automated Multi-Game Card Reading Apparatus", filed Jan. 7, 2013, the disclosure of which is hereby incorporated by reference as though set forth fully herein.

Figure 8:
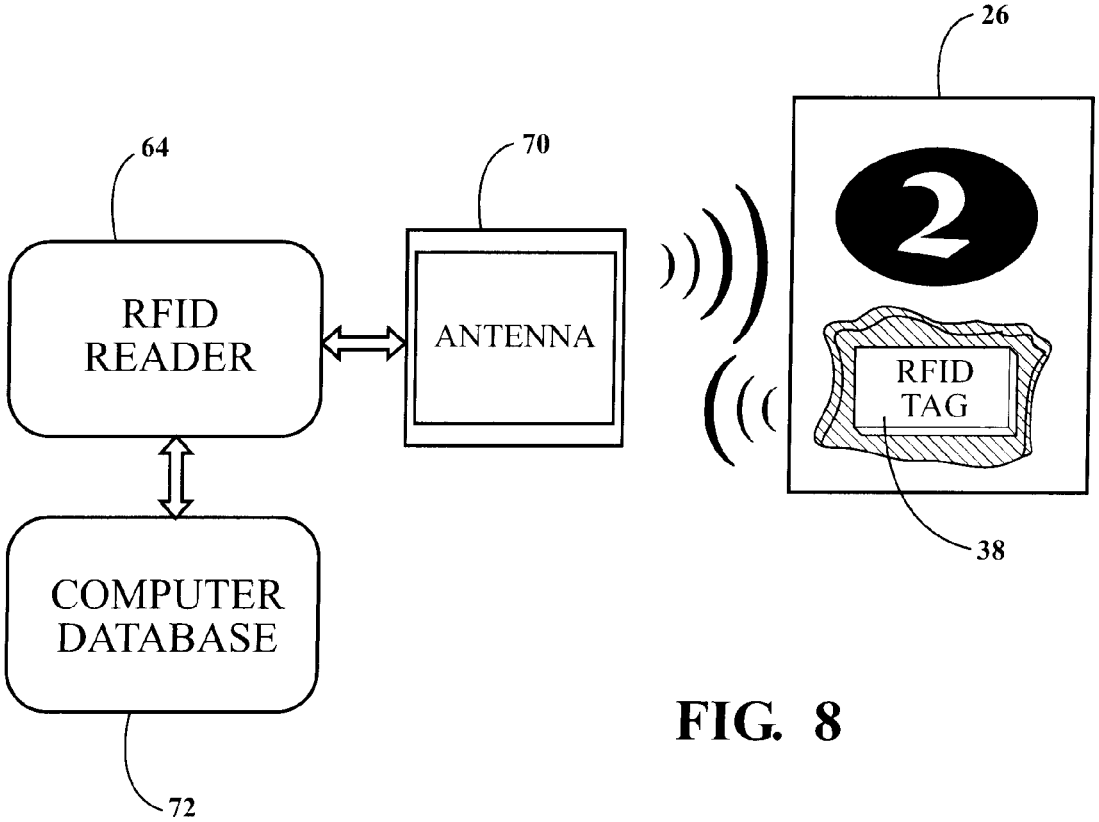
FIG. 8 is a schematic diagram illustrating a method for identifying a specific playing card in accordance with an aspect of the disclosure.

FIG. 8 schematically illustrates the steps of reading a card 26 according to an aspect of the disclosure. As shown, the card 26 bears indicia related to the game of roulette, specifically the number 00 and the color green. The RFID tag 38 has that information stored thereon. When the card 26 is brought into proximity with an RFID card reader 64, which includes a wireless antenna 70 to communicate with the RFID tag 38, the RFID card reader 64 reads the information about the card that is stored on the RFID tag 38. The card indicia information is then transmitted to a computer database 72 so that it can be utilized to settle wagers and display it on the monitors 62 and the terminals 60.

As discussed previously, according to an aspect, almost any of the known games of chance can be played using the card shuffling machine 12 of the disclosed system, so long as the number of cards and the number of their represented indicia result in a probability of decision which is equivalent to the traditionally played game. For example, it has been discussed that it is possible to play a game of chance which conforms substantially to the traditional rules of roulette using cards bearing indicia substantially as depicted in FIG. 9. Illustrated in FIG. 10 are thirty-six cards that are marked with distinct indicia selected from the group consisting of the whole numbers 1 to 36. Also in keeping with the traditional rules of roulette, eighteen of the cards may be marked with the color red indicia, while eighteen different cards are marked with the color black indicia. This corresponds to the red and black colors used in traditional roulette. Two additional cards are colored with the green indicia and marked 0 and 00, respectively. When these cards are arranged in the trays of the card shuffling machine 10, any one of these cards 26 can be selected from the set of cards, and its particular indicia used to decide the game of chance.

According to another aspect, the card shuffling machine 10 can be used to play a game according to the traditional rules of craps. The randomizing device used in the traditional game of craps consist of a pair of six-sided dice, each side of the dice bearing a dot representative of the whole numbers 1 to 6. Considering the pair of dice together, thirty-six possible combinations can be achieved by the two dice. Accordingly, as shown in FIG. 10, the set of cards may be marked with indicia representing the whole numbers 2 to 12 in the following combinations: one number 2, two number 3's, three number 4's, four number 5's, five number 6's, six number 7's, five number 8's, four number 9's, three number 10's, two number 11's, and one number 12. These cards may also be imprinted with indicia which pictorially represent all thirty-six available combinations of a pair of six-sided dice. When arranged in a turntable consisting of thirty-six equally spaced trays, complete odds parity with the traditional game of craps can be achieved through use of the subject card shuffling machine 10. To add variety to the traditional game of craps, one or two additional cards bearing the indicia 0 and 00 can be added. Likewise, other games of chance can be played using the card shuffling machine 10 of this invention as the randomizing device. Such games may include blackjack, war, and many others.

According to an aspect, the cards 26 may be constructed of a hard plastic. The back sides of the cards can also include the game logo on the back of the card. The shuffler machines may be configured to hold the RFID-enabled hard plastic custom cards shown in FIGS. 7, and 9-10. There are several advantages to using these custom cards. First, it is a huge increase in game security. The cards are memorized by the computer system one at a time when they are placed into the shuffler 10. If an unauthorized person tries to insert a card that was not one originally placed in the shuffler, it will not read therefore it will not communicate with the game server which settles wagers at the terminals. This eliminates one cheating threat. By using custom cards, the system can eliminate the need for the operator to manually input the decision number. Instead, the operator removes the card from the shuffler and lays it on the reader. The pre-programmed software running on the linked computer server displays the card # which allows the operator to confirm that they match before proceeding. The information is then posted on the game terminal and public display and all wagers are settled based on this confirmation. The software will not allow the operator to enter the wrong number. This also eliminates Dealer/Customer collusion which is a major problem on live table games. Alternatively, the indicia of the card could be fed automatically to computer based on the information from the RFID tag 38.

According to another aspect, the turntable 14 can be made conveniently separable from the base 12, so that a different turntable 14 having a different number of trays 24 can be substituted to play different games. Thus, the subject card shuffling machine 10 is readily adaptable from one game method to the next. Although not illustrated in FIG. 1, the sector of the stage section 20 which is occupied by each tray 24 may be colored, for example red or black, to correspond with coloring indicia provided on its associated card 26. Other color and decorative variations may also be imposed depending on taste and application. Furthermore, the overall configuration of the turntable 14 can be varied greatly for stylistic reasons, without departing from the spirit or scope of this invention.

A method for playing a game of chance using the subject card shuffling machine 10 can include the steps of providing a physical bet selection region, and then making a forecast on the outcome of a game of chance by associating a marker on the bet selection region with at least one of the many possible game outcomes. As described above, when using the electronically posted version of this invention as illustrated in FIG. 4 together with computerized terminals 40 provided for each individual player, the bet selection region appears as a graphical image on the computerized monitor 42 and the placing of markers is a purely electronic expression. However, in accordance with one aspect, the bet selection region will comprise a physical game table which is here illustrated in FIG. 1 as roulette, but in other game types will vary accordingly. The placing or associating of markers on the bet selection region with a particular forecast can be done in many ways, but commonly involves placing a chip or other marking device on an available bet selection. Once all bets have been placed, the dealer or game operator can accelerate the turntable 14 to a maximum rotating speed by grasping one of the dividers 28 and forcibly spinning the turntable 14. Other techniques can be used including mechanized and motorized rotation. Once a maximum rotating speed has been achieved, the turntable 14 is allowed to freely (i.e., without power input) rotate about its central axis A. Left to its own devices through the natural frictional resistance in the underlying bearing mechanisms, the turntable 14 will gradually slow to a stop. However, to hasten the game decision, the detent 30 may be slid, rotated or otherwise moved into an active position wherein the resiliently bendable tongue, fixed relative to the base 12, encounters each peg-like divider 28 individually, with each frictional encounter retarding the spin of the wheel until there have been enough such encounters to stop the turntable 14. Thus, the turntable 14 is progressively slowed and stopped at a random angular position relative to the base 14. The detent 30 itself, or a separate pointing device can be used to identify one of the plurality of trays 24. The card 24 associated with that one tray 24 can then be removed from its slot and a game decision is announced based on the indicia borne on that one card 24. The announcing step may include projecting a video image of the card 26 or, in a more sophisticated embodiment, scanning a machine-readable code on the card 26.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A card shuffling machine for a game of chance, comprising:

a body portion, configured to rotate about a generally vertical axis;

a plurality of slots disposed on the body portion and spaced generally uniformly about the vertical axis of rotation, each of the plurality of slots being configured to receive a card from a defined set of cards, with each card in the defined set of cards bearing indicia on a face thereof relevant to an outcome of the game of chance;

at least one reader in communication with at least one of the plurality of slots, the at least one reader configured to automatically obtain indicia information from at least one card while that at least one card is disposed in one of the plurality of slots without the need to remove the at least one card from its respective slot;

a display in communication with the at least one reader for displaying the obtained indicia of the least one card.

2. The card shuffling machine of claim 1, wherein each of the plurality of slots is configured to receive one card from the defined set of cards such that the indicia of each of the cards is oriented generally perpendicular to the vertical axis; and wherein each of the plurality of slots is configured such that at least part of the card indicia is concealed while disposed in the slot.

3. The card shuffling machine of claim 1, wherein each card is oriented in one of the plurality of slots such that the indicia is oriented generally parallel to the vertical axis of rotation.

4. The card shuffling machine of claim 1, wherein each card in the defined set of cards includes a readable tag associated therewith, wherein the readable tag contains information about indicia of that card stored thereon.

5. The card shuffling machine of claim 4, wherein the readable tag is an RFID tag and the at least one reader is an RFID reader that is configured to communicate with the RFID tag to obtain the indicia information of the card.

6. The card shuffling machine of claim 4, wherein the readable tag is a bar code and the at least one reader is a bar code reader that is configured to communicate with the bar code to obtain the indicia information of the card.

7. The card shuffling machine of claim 1, wherein the at least one reader is a camera that obtains indicia information of at least one card.

8. The card shuffling machine of claim 1, further comprising:

a plurality of readers each disposed on the body portion and associated with a respective one of the plurality of slots for obtaining indicia information about each of the cards while they reside in one of the plurality of slots.

9. The card shuffling machine of claim 8, further comprising:

a plurality of displays disposed on the shuffling machine, each of the displays being disposed adjacent one of the plurality of slots;

each of the plurality of displays being in communication with a respective one of the plurality of readers that is in communication with the slot adjacent that display to obtain indicia information of the card in that slot, each of the plurality of displays being configured to display indicia information of the card obtained from the respective reader.

10. The card shuffling machine of claim 1, further comprising:

a mechanical arm, which is configured to remove a selected card of the defined set of cards from its respective slot.

11. The card shuffling machine of claim 1, further comprising:

a processor in communication with the at least one reader for obtaining indicia information about at least one of the cards in the defined set of cards.

12. The card shuffling machine of claim 11, further comprising:

a plurality of player terminals in communication with the processor and configured to receive wagers on an outcome of the game of chance.

13. The card shuffling machine of claim 11, wherein at least one of the plurality of player terminals is a remote terminal.

14. The card shuffling machine of claim 1, wherein the indicia information of each of the defined set of cards is relevant to an outcome of the game of chance selected from one of the following: black jack, poker, war, and craps.

15. A system for playing a game of chance, comprising:

a game surface;

a card shuffling device disposed adjacent the game surface, the card shuffling device comprising:

a rotatable portion configured to rotate about a vertical axis of rotation;

a plurality of slots disposed in the rotatable portion and generally uniformly disposed about the vertical axis of rotation;

a plurality of card readers disposed on the rotatable portion, each of the plurality of card readers configured to communicate with one of the plurality of slots to obtain indicia information about a card while disposed in each of the plurality of slots;

a processor in communication with each of the plurality of card readers for receiving the read indicia information of the cards disposed in each of the slots; and a display device for displaying the read indicia information;

a communication module for communicating with a plurality of electronic terminal devices to facilitate receipt and automatic resolution of any wagers on an outcome of the game of chance based on indicia of a selected card.

16. The system of claim 15, further comprising:

a plurality of display devices disposed on the rotatable portion, one of the plurality of display devices in communication with a respective one of the plurality of readers for displaying the obtained indicia information of each card while disposed in its respective one of the plurality of slots.

17. The system of claim 16, wherein the card in each of the plurality of slots includes a readable tag configured to store indicia information about the card, which can be read by the reader.

18. The system of 17, wherein the readable tag is an RFID tag and wherein the reader is an RFID reader.

19. The system of claim 17, wherein the readable tag is a barcode and wherein the reader is a barcode reader.

20. A card shuffling machine for a game of chance, comprising:

a body portion, configured to rotate about a generally vertical axis;

a plurality of slots disposed on the body portion and spaced generally uniformly about the vertical axis of rotation, each of the plurality of slots being configured to receive a card from a defined set of cards, with each card in the defined set of cards bearing indicia on a face thereof relevant to an outcome of the game of chance;

a plurality of RFID readers each disposed on the body portion and associated with a respective one of the plurality of slots, each of the plurality of RFID readers being configured to communicate with a readable tag associated with each card in the defined set of cards to obtain indicia information from each of the cards while they reside within the plurality of slots;

a plurality of display devices each associated with and in communication with one of the plurality of RFID readers for displaying the obtained indicia of each of the plurality of cards; and a communication module in communication with the plurality of RFID readers and configured to communicate with a processor to facilitate resolution of wagers placed on an outcome of the game of chance.

21. The system of claim 20, wherein each of the display devices is located on the body portion.

* * * * *